US009498021B2

(12) United States Patent
Campbell et al.

(10) Patent No.: US 9,498,021 B2
(45) **Date of Patent: *Nov. 22, 2016**

(54) CLEAT FOR FOOTWEAR

(71) Applicant: Under Armour, Inc., Baltimore, MD (US)

(72) Inventors: Derek Campbell, Columbia, MD (US); Nelson Lin, ShenZhen (CN); Clinton Zhu, GuangZhou (CN); Cori Koch, Baltimore, MD (US); Justin Schlothauer, Forest Hill, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/725,170

(22) Filed: May 29, 2015

(65) Prior Publication Data

US 2015/0257484 A1 Sep. 17, 2015

Related U.S. Application Data

(62) Division of application No. 13/912,600, filed on Jun. 7, 2013, now Pat. No. 9,113,676.

(60) Provisional application No. 61/810,092, filed on May 23, 2013.

(51) Int. Cl.

| | |
|---|---|
| ***A43C 15/02*** | (2006.01) |
| ***A43B 13/26*** | (2006.01) |
| ***A43C 15/16*** | (2006.01) |

(52) U.S. Cl.

CPC ..... *A43B 13/26* (2013.01); *A43C 15/161* (2013.01); *A43C 15/162* (2013.01)

(58) Field of Classification Search

CPC .. A43B 13/22; A43B 13/223; A43B 13/226; A43B 13/24; A43B 13/26

USPC ..... 36/67 R, 127, 128, 129, 59 R, 134

See application file for complete search history.

(56) References Cited

U.S. PATENT DOCUMENTS

| | | | | |
|---|---|---|---|---|
| 527,403 | A | 10/1894 | Buxton | |
| 1,053,506 | A | 2/1913 | Hersey | |
| 2,006,637 | A | 7/1935 | Goldenberg | |
| 3,040,450 | A | 6/1962 | Phillips | |
| 3,600,831 | A | 8/1971 | Olsson et al. | |
| 4,107,858 | A * | 8/1978 | Bowerman | A43B 5/00 36/134 |
| 4,180,923 | A | 1/1980 | Dassler | |

(Continued)

FOREIGN PATENT DOCUMENTS

| | | | |
|---|---|---|---|
| DE | 3915157 | A1 | 11/1989 |
| EP | 0346624 | A2 | 12/1989 |

(Continued)

*Primary Examiner* — Ted Kavanaugh

(74) *Attorney, Agent, or Firm* — Harness, Dickey & Pierce, P.L.C.

(57) ABSTRACT

An improved cleat design is provided for article of footwear. At least one cleat is arranged on a bottom surface of the outsole, such that the cleat is disposed partially within the outsole and extends substantially perpendicular from the bottom surface of the outsole. The cleat includes an aperture such that a portion of the outsole extends through the aperture in a direction substantially parallel to the bottom surface of the outsole to retain the at least one cleat in a desired position relative to the outsole.

14 Claims, 10 Drawing Sheets

(56) References Cited

U.S. PATENT DOCUMENTS

| | | | |
|---|---|---|---|
| 4,644,672 | A | 2/1987 | Dassler et al. |
| 5,058,292 | A | 10/1991 | Tanel |
| 5,628,129 | A | 5/1997 | Kilgore et al. |
| 5,732,484 | A | 3/1998 | Grutza et al. |
| 5,987,784 | A | 11/1999 | Bignell |
| 6,101,746 | A | 8/2000 | Evans |
| 6,557,270 | B2 | 5/2003 | Nakano et al. |
| 7,047,675 | B2 | 5/2006 | Briant et al. |
| 7,428,790 | B2 | 9/2008 | Pellerin |
| 8,215,035 | B2 | 7/2012 | Mills et al. |
| 9,055,787 | B2 | 6/2015 | Koch et al. |
| 9,113,676 | B2 | 8/2015 | Campbell et al. |
| 2001/0025440 | A1* | 10/2001 | Annovi ..... A43C 15/16 36/128 |
| 2005/0097783 | A1 | 5/2005 | Mills et al. |
| 2009/0235558 | A1 | 9/2009 | Auger et al. |
| 2010/0257756 | A1 | 10/2010 | Chang |
| 2015/0040438 | A1 | 2/2015 | Baucom et al. |

FOREIGN PATENT DOCUMENTS

| | | |
|---|---|---|
| JP | H5505730 | 8/1993 |
| JP | 2001120308 A | 5/2001 |
| JP | 2004136095 | 5/2004 |
| JP | 2014226558 | 12/2014 |

* cited by examiner

CLEAT FOR FOOTWEAR

CROSS-REFERENCE TO RELATED APPLICATIONS

This application is a divisional of U.S. Ser. No. 13/912,600 filed Jun. 7, 2013 which claims the benefit of U.S. Provisional Application No. 61/810,092 filed May 23, 2013. The disclosures of the above applications are incorporated herein by reference.

FIELD

The present disclosure relates to an improved cleat for footwear.

BACKGROUND

Professional and amateur athletes, as well as outdoor enthusiasts, often find it advantageous to wear shoes or other footwear that includes a cleated sole. Examples of such footwear might include baseball shoes, soccer shoes, football shoes, hiking shoes, golf shoes, or track & field spikes. Cleats can prevent numerous leg and foot injuries by reducing slippage and providing for better foot traction on a variety of surfaces.

Cleats come in a variety of different shapes, sizes and styles. A cleat might take the form of a spike, a stud, a blade, or any other similar protrusion located on the underside of the footwear. In addition, a cleat might have different dimensions depending on the activity and the surface on which it will be used. For example, a cleat used on a hard surface, such as a track, may have a lower profile or height than a cleat used on grass or dirt. Moreover, cleats might be removable or permanently attached to the outsole of the shoe or other footwear.

In order to improve the performance of cleats and cleated footwear, it is often desirable to have a lightweight cleat that is securely fixed to the underside of the footwear, and is designed in such a way as to provide maximum traction and durability.

This section provides background information related to the present disclosure which is not necessarily prior art.

SUMMARY

This section provides a general summary of the disclosure, and is not a comprehensive disclosure of its full scope or all of its features.

An improved cleat design is provided to enhance an article of footwear. At least one cleat is arranged on a bottom surface of the outsole, such that the cleat is disposed partially within the outsole and extends substantially perpendicular from the bottom surface of the outsole. The cleat includes an aperture such that a portion of the outsole extends through the aperture in a direction substantially parallel to the bottom surface of the outsole to retain the at least one cleat in a desired position relative to the outsole.

In one aspect of this disclosure, the cleat is further defined to include a retention portion disposed in the outsole adjacent to the bottom surface of the outsole and a ground-engaging portion which extends from the retention portion and outside of the outsole. The aperture can be formed in the retention portion and can be defined as an oval with a longitudinal axis of the oval oriented substantially parallel to the bottom surface of the outsole. The retention portion can also include a flange extending therefrom in a direction substantially parallel to the bottom surface of the outsole.

The cleat can further include a cap, where the cap protrudes outside of the outsole and has a cross-sectional area larger than a cross-sectional area of the retention portion, such that the cross-sectional area of the retention portion and the cap are taken in relation to the longitudinal axis.

In another aspect of this disclosure, a midsole of the footwear has a substantially planar bottom surface, such that the at least one cleat is disposed entirely below the bottom surface of the midsole.

In yet another aspect of this disclosure, the outsole of the footwear can include at least one nodule integrally formed with and extending outward from the bottom surface of the outsole, wherein the at least one cleat is encapsulated partially by the at least one nodule. The nodule has formed by one or more arcuate side surfaces extending from the bottom surface of the outsole to a distal end from which the cleat protrudes from, where cross-sectional area between the side surface increases continually from the distal end to the bottom surface of the outsole.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
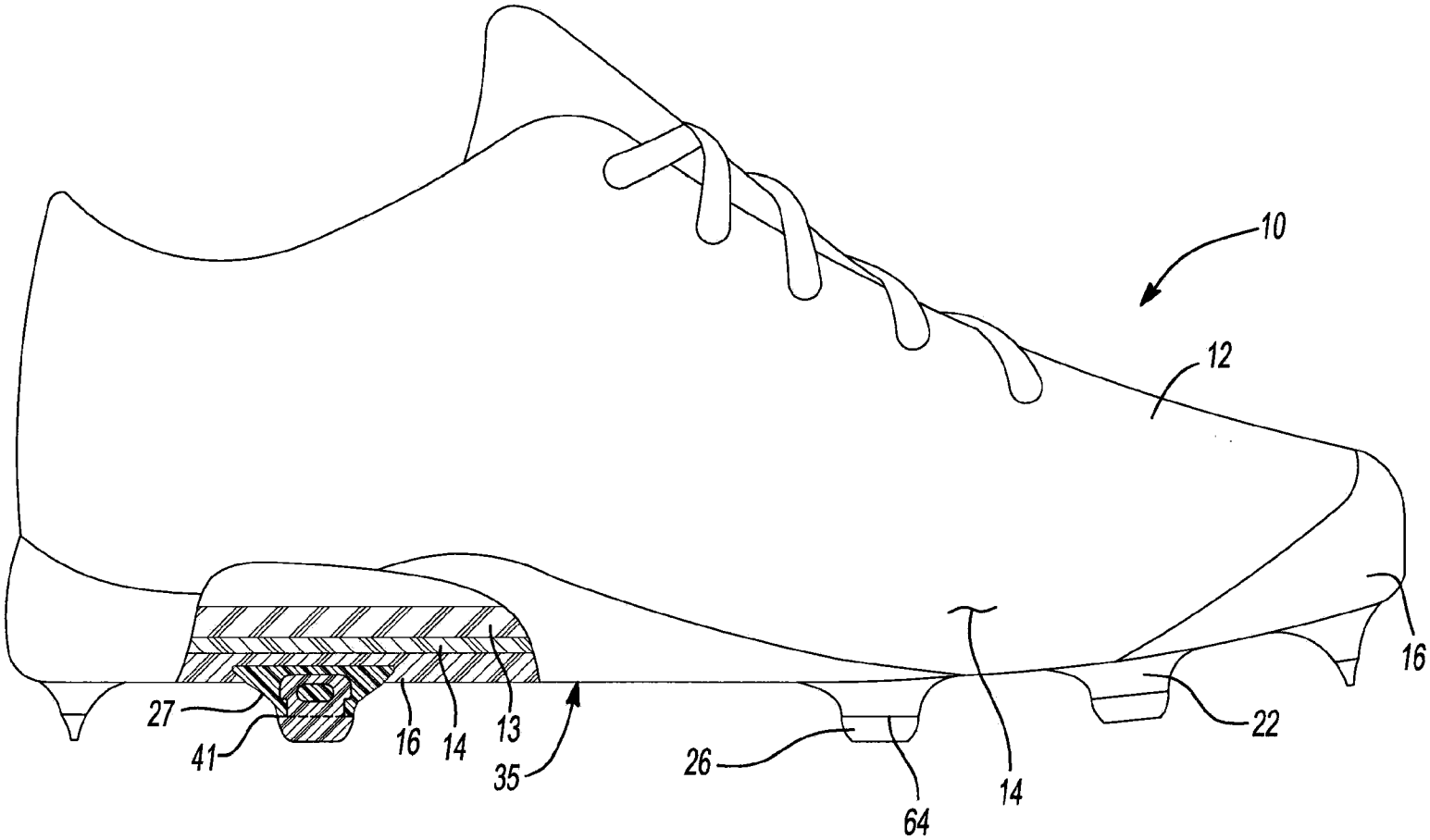
FIG. 1 is a side view of an article of footwear in accordance with the principles of the present disclosure, showing a partial cross-section of the article of footwear.
Figure 5:
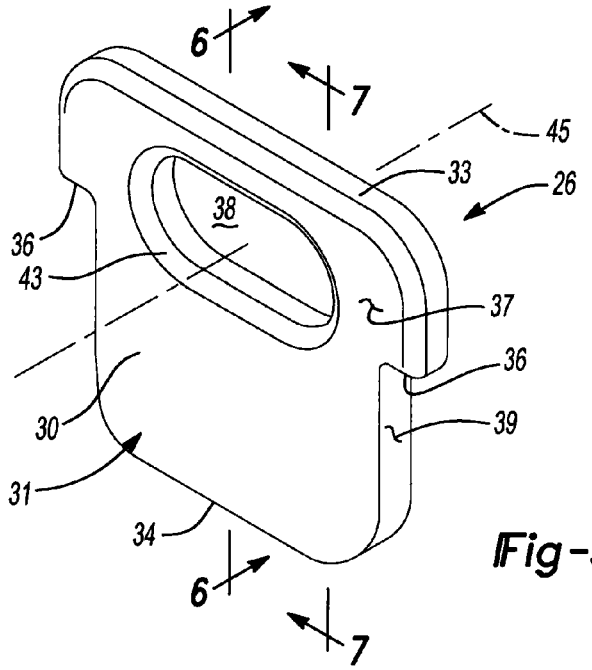
FIG. 5 is a perspective view of a cleat of the article of footwear of FIG. 1.
Figure 9:
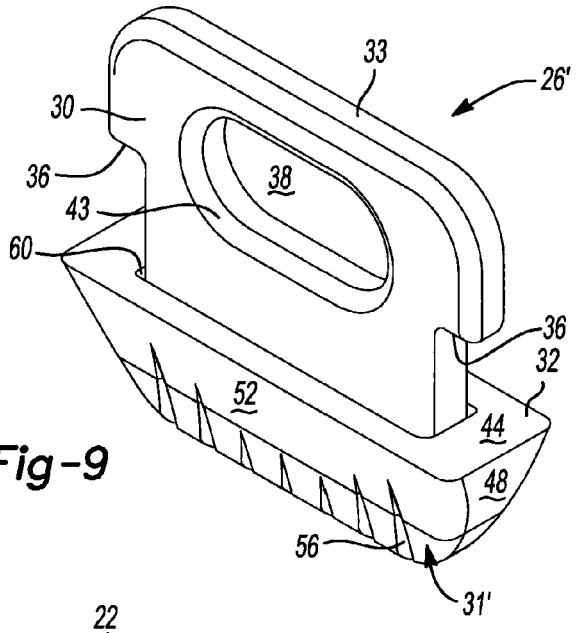
FIG. 9 is a perspective view of another embodiment of the cleat of FIG. 5.
Figure 10A:
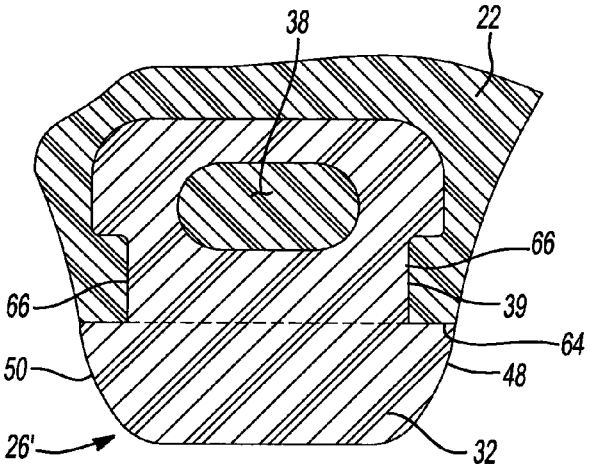
Figure 10B:
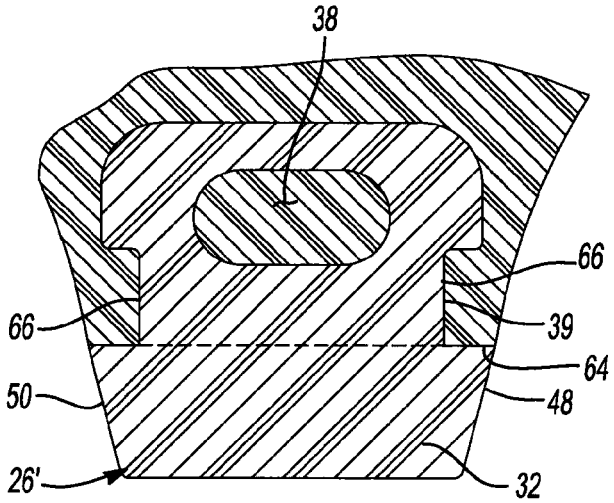
Figure 11A:
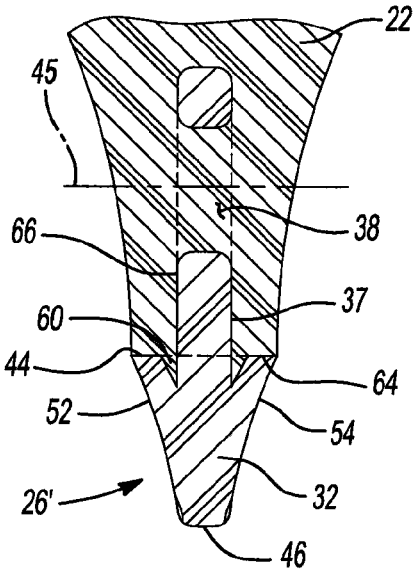
Figure 11B:
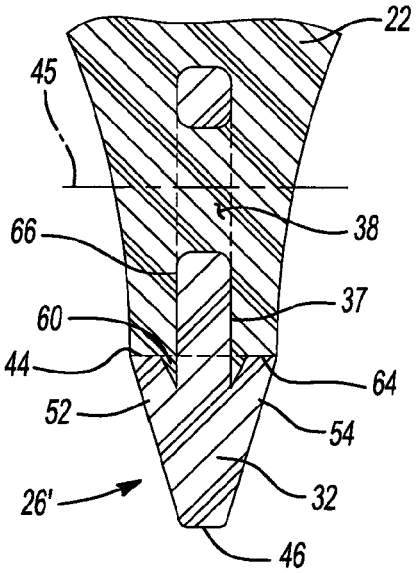
Figure 12:
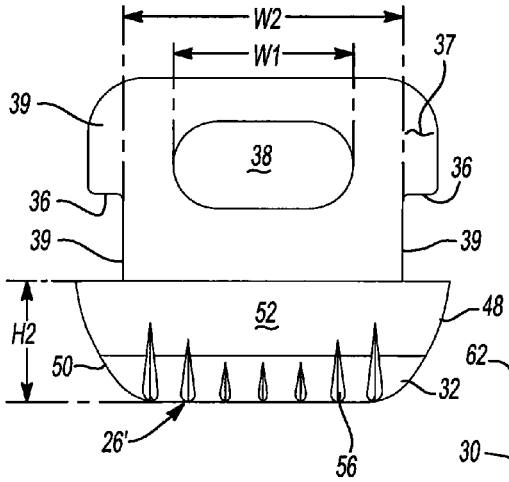
Figure 13:
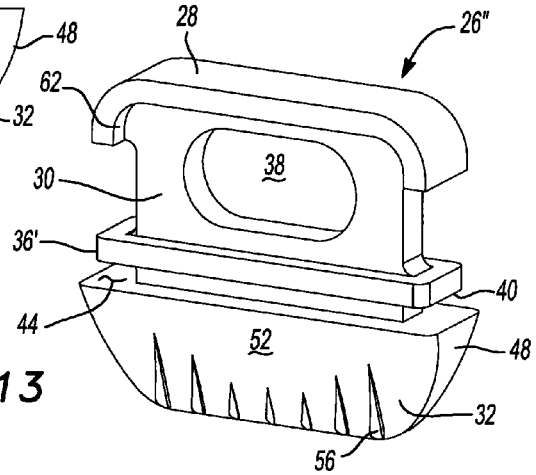
Figure 14:
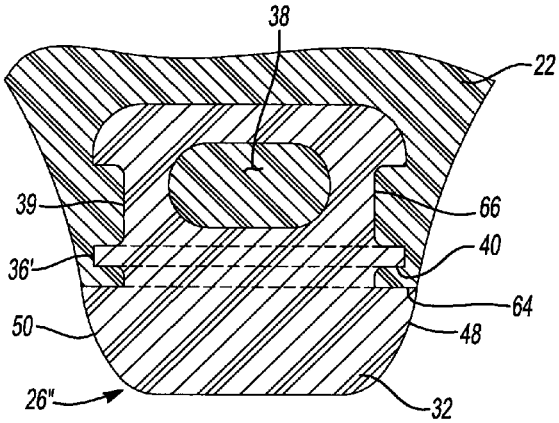
Figure 15:
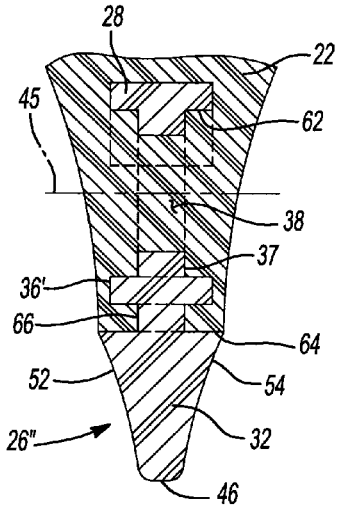
Figure 16A:
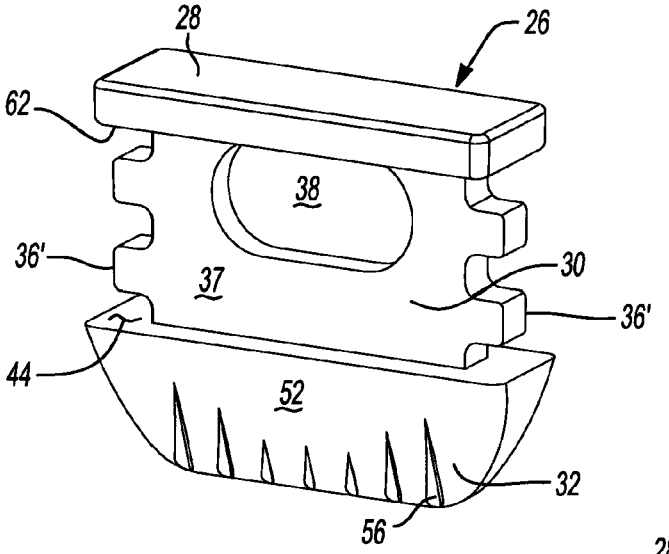
Figure 16B:
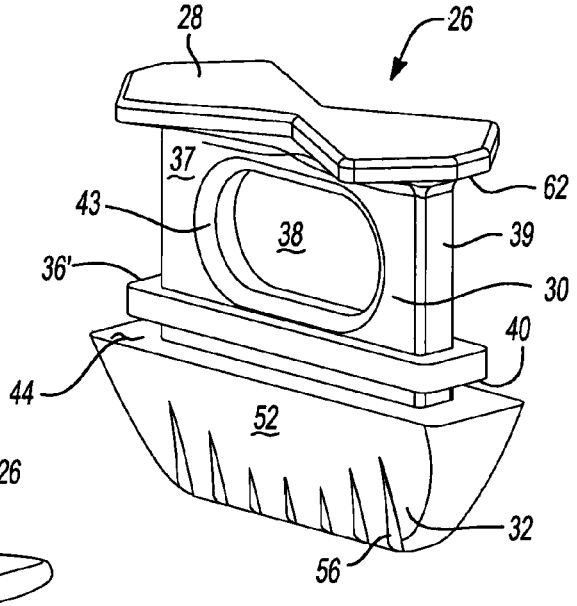
Figure 16C:
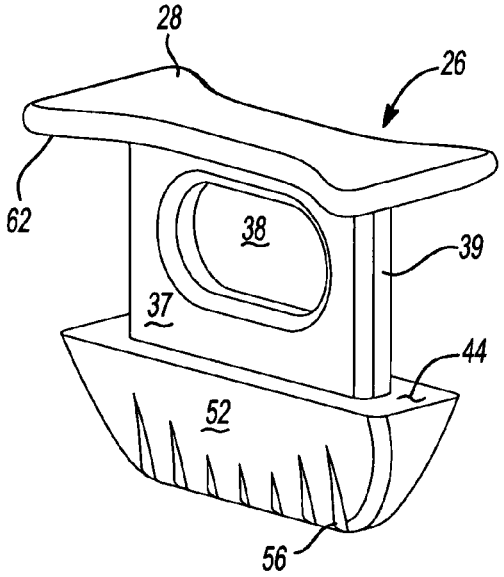
Figure 17A:
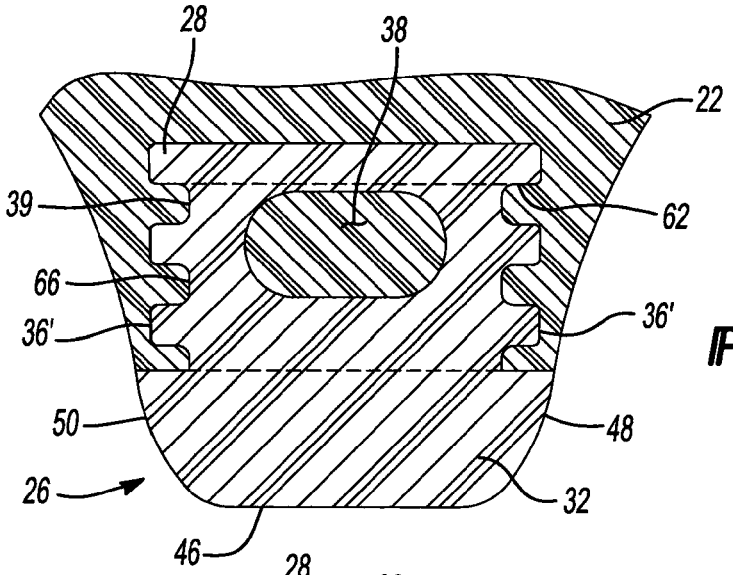
Figure 17B:
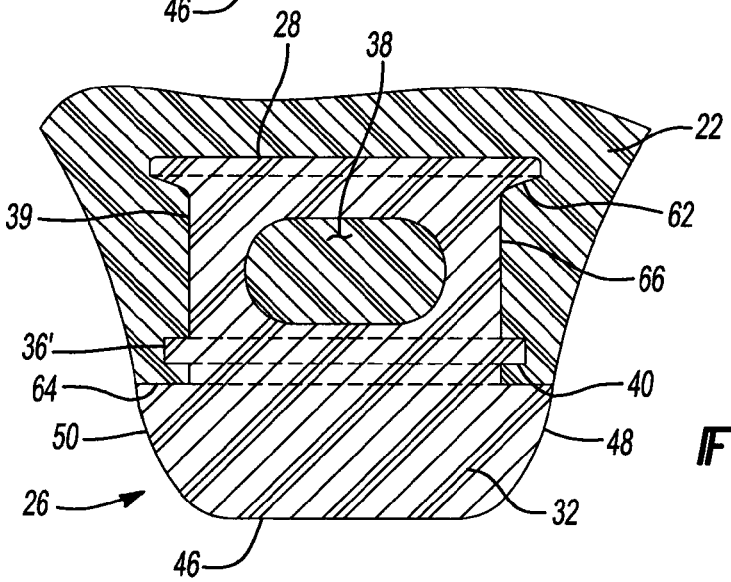
Figure 17C:
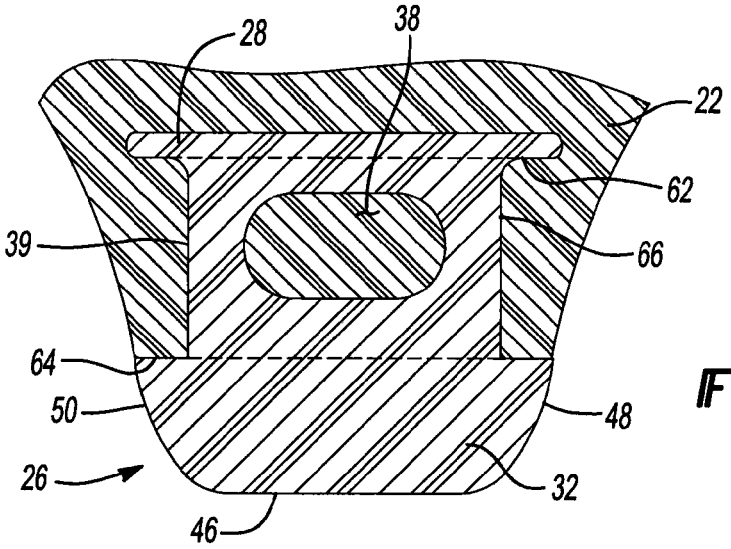
Figure 18A:
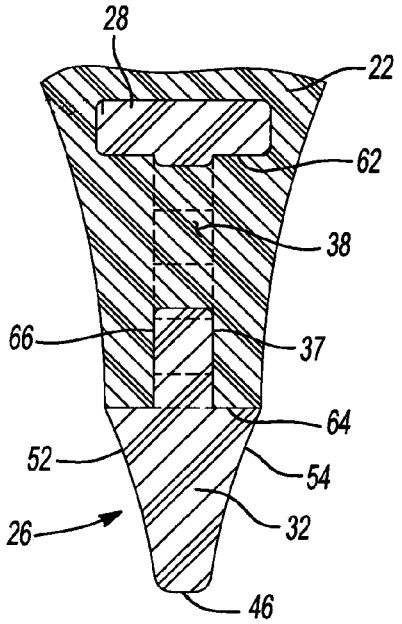
Figure 18B:
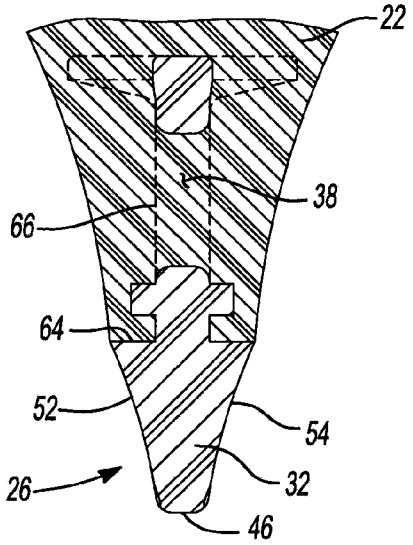
Figure 18C:
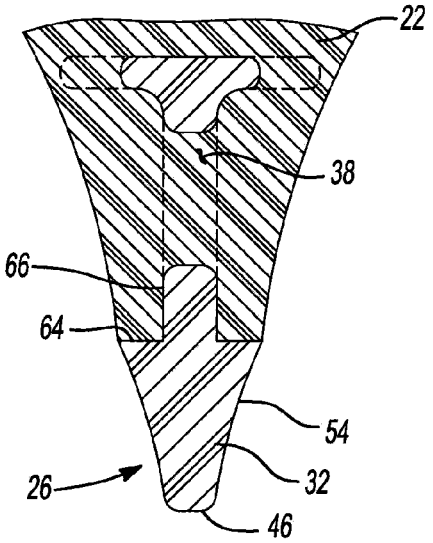

FIG. 10*a* is a partial cross-sectional view of the article of footwear of FIG. 1, showing the cleat embodiment of FIG. 9;

FIG. 10*b* is a partial cross-sectional view of the article of footwear of FIG. 1, showing another configuration of the cleat embodiment of FIG. 9;

FIG. 11*a* is partial cross-sectional view of the article of footwear of FIG. 1, showing the cleat embodiment of FIG. 9;

FIG. 11*b* is a partial cross-sectional view of the article of footwear of FIG. 1, showing an another configuration of the cleat embodiment of FIG. 9;

FIG. 12 is a front view of the cleat of FIG. 9;

FIG. 13 is a perspective view of another embodiment of the cleat of FIG. 5;

FIG. 14 is a partial cross-sectional view of the article of footwear of FIG. 1, showing the cleat embodiment of FIG. 13;

FIG. 15 is partial cross-sectional view of the article of footwear of FIG. 1, showing the cleat embodiment of FIG. 13;

FIGS. 16A-16C are perspective views of another embodiment of the cleat of FIG. 13;

FIGS. 17A-17C are partial cross-sectional views of the article of footwear of FIG. 1, showing the cleat embodiments of FIGS. 16A-16C; and FIGS. 18A-18C are partial cross-sectional views of the article of footwear of FIG. 1, showing the cleat embodiments of FIGS. 16A-16C.

Corresponding reference numerals indicate corresponding parts throughout the several views of the drawings.

DETAILED DESCRIPTION

Example embodiments will now be described more fully with reference to the accompanying drawings.

With reference to the figures, an article of footwear 10 is provided and may include an upper 12, a sockliner or insole 13, a midsole 14, and an outsole 16. The upper 12 and the midsole 14 cooperate to position and retain a user's foot (not shown) relative to the outsole 16 during use of the article of footwear 10. It will be appreciated that an article of footwear 10 may include other elements and parts, including but not limited to laces, an insole, and a stiff toe portion. The type and quantity of elements and parts of the article of footwear 10 may depend on the particular use for which the article of footwear is designed. Relevant parts and elements of an article of footwear 10 will be described herein.

Figure 2:
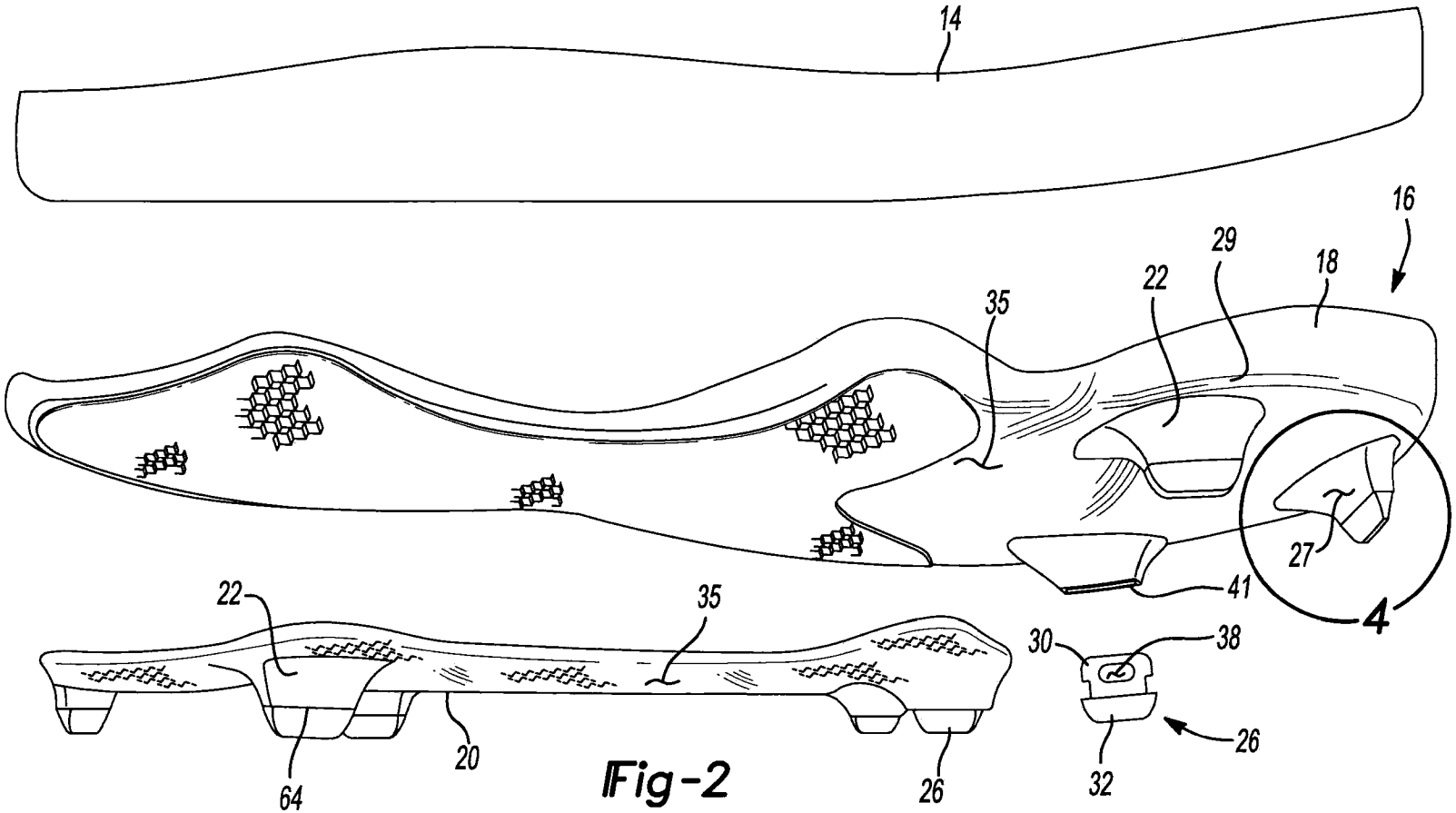
FIG. 2 is an exploded view of an outsole of the article of footwear of FIG. 1.
Figure 3:
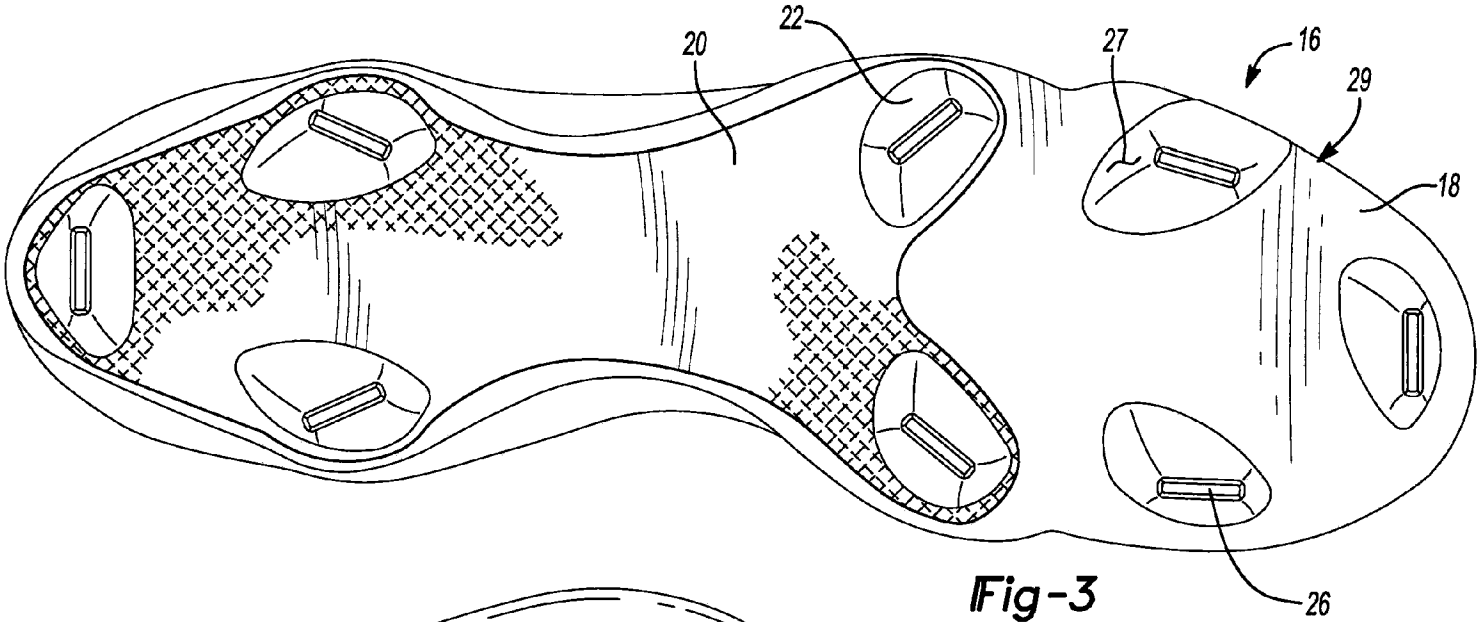
FIG. 3 is a bottom view of the outsole of the article of footwear of FIG. 1.

With reference to FIG. 2, in an example embodiment the outsole 16 may include a first member 18 and a second member 20. The first member 18 may be fixed to the midsole 14 and may be formed of a substantially resilient material such as thermoplastic polyurethane, nylon and fiberglass compound, Pebax®, or another type of plastic material. The second member 20 may be fixed to the first member 18 and be formed of a substantially rigid material such as carbon fiber, thermoplastic polyurethane, nylon and fiberglass compound, Pebax®, or another type of plastic material. The second member 20 may be fixed to the first member 18 with an adhesive, overmolding, three-dimensional printing process, or any other known fastening system. In an alternative embodiment, the outsole 16 may be formed as a single-piece.

With reference to FIGS. 1-4, the outsole 16 may include a plurality of pod elements or nodules 22. A cleat is encapsulated partially within each nodule and protrudes therefrom in a direction substantially perpendicular to the bottom surface of the outsole. The quantity and arrangement of cleats 26 and nodules 22 on the outsole 16 may depend on the particular use for which the article of footwear 10 was designed. By way of example only, an article of footwear 10 designed for baseball may include fewer cleats 26 than an article of footwear designed for football (or vice versa), while an article of footwear 10 designed for hiking may not include any cleats 26 and an article of footwear designed for track may not include any nodules 22. Different arrangements for the cleats 26 and nodules 22 fall within the scope of this application.

Figure 4:
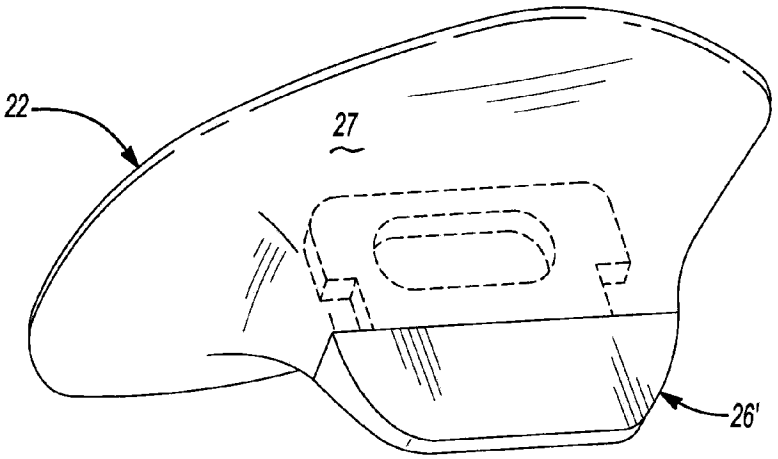
FIG. 4 is a perspective view of a nodule of the article of footwear of FIG. 1, showing a cleat therein.

With particular reference to FIG. 4, the nodule 22 may include an arcuate surface 27 extending from the bottom surface 35 of the outsole 16 to a distal or end portion 41 of the nodule 22. Depending on the location of the nodule 22 relative to the outsole 16, the arcuate surface 27 may have a varying symmetrical or asymmetrical profile with varying degrees of curvature that allow the nodule 22 to dissipate forces transmitted through the outsole 16 from the ground, before such forces are transmitted to the user's foot. For example, a portion of the arcuate surface 27 may extend with a first profile to a peripheral edge 29 of the outsole 16, while another portion of the arcuate surface 27 may extend with a second profile to the bottom surface 35 of the outsole 16. In an example embodiment, the cross-sectional area between the side surfaces increases continually from the end portion 41 to the bottom surface of the outsole 16. The nodules 22 may be integrally formed with the first member 18 and/or the second member 20 and thus formed of the same material as the first member 18 and/or the second member 20. The material used to form the nodule 22 can have a hardness or density sufficient to ensure that the cleat 26 remains stable and does not move or shift within the nodule when the cleat contacts the ground or surface on which the article of footwear 10 is being used. For example, the nodule 22 may be formed of a thermoplastic polyurethane having a hardness in the range of 60 D to 1174 D in accordance with the ASTM D2240 standard. In some embodiments, it is contemplated that the nodules 22 may be removably attached to the outsole 16 by a screw, clip, press-fit engagement, or other attachment system known in the art.

FIGS. 5-8 depict an example embodiment of a cleat 26. In the example embodiment, the cleat 26 is comprised generally of a stem 30. The stem 30 includes a top end 33 and a bottom end 34 separated by substantially planar and parallel first sidewalls 37 and substantially planar and parallel second sidewalls 39. The stem 30 may be substantially flat with a rectangular cross section. The edges and corners of the stem 30 may be beveled or radiused. Beveling the edges and corners of the stem 30 may help to dissipate the pressure imparted by the edges and corners of the stem 30 on the nodules 22 and/or outsole 16 (via a larger contact surface area), and thus ensure that the cleat 26 is securely fastened to the nodules and/or outsole.

In the example embodiment, the cleat 26 is formed from 1050 grade stainless steel. The cleat 26 may be formed from titanium, aluminum, other grades of steel as well as other types of metals. The cleat may also be formed from other materials of suitable hardness and durability. In some embodiments, the cleat 26 may be coated with a layer of tungsten 31 for improved strength, durability, and wear resistance. The layer of tungsten 31 may entirely coat the stem or coat only the portions of the cleat which protrude from the nodule or engage the surface on which the article of footwear 10 is being used. The size and shape of the cleat 26, as will be described in more detail below, may significantly reduce the weight of the cleat, as compared to a prior art cleat. Specifically, the size and shape of the cleat 26 may reduce the weight of the cleat 26 by 40-50%, or 3 grams per cleat, such that the weight of the article of footwear 10 is reduced by 1-2 ounces.

In the example embodiment, the stem 30 includes a retaining feature (also referred to herein as the retention portion). The retaining feature functions to secure the cleat 26 to the outsole 16. In the example embodiment, the retaining feature is further defined as an aperture 38. The aperture 38 is generally located adjacent to the top end 33 of the stem 30. An axis 45 of the aperture 38 may be substantially perpendicular to the first and second sidewalls 37, 39 of the stem, and substantially parallel to the bottom surface 35 of the outsole 16. During assembly, a portion of the outsole extends through the aperture in a direction substantially parallel to the bottom surface of the outsole to retain the cleat in a desired position relative to the outsole. It is envisioned that the aperture 38 may have a variety of shapes, including a circle, an ellipse, an oval, a square, and a rectangle, and may include radiused or beveled edges 43.

Figure 8:
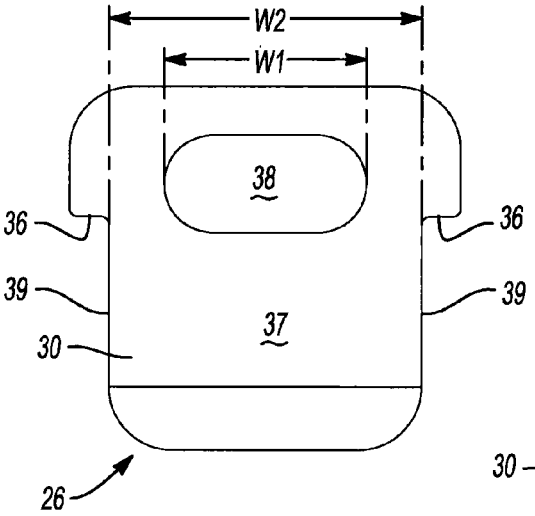
FIG. 8 is a front view of the cleat of FIG. 5.

To the extent the structural integrity of the stem 30 and the cleat 26 are not compromised, the weight of the cleats 26 can be reduced by increasing the size of the aperture 38. With particular reference to FIG. 8, in one embodiment, the width W1 of the aperture 38 is between forty-five and fifty-five percent of a width W2 of the stem 30. In another embodiment, the width W1 of the aperture 38 is fifty-one percent of the width W2 of the stem 30. In this way, the weight of the cleat 26 can be reduced. Moreover, because metal cleats can contribute substantially to the weight of the footwear, the overall weight of the footwear is also reduced by increasing the size of the aperture.

Figure 6:
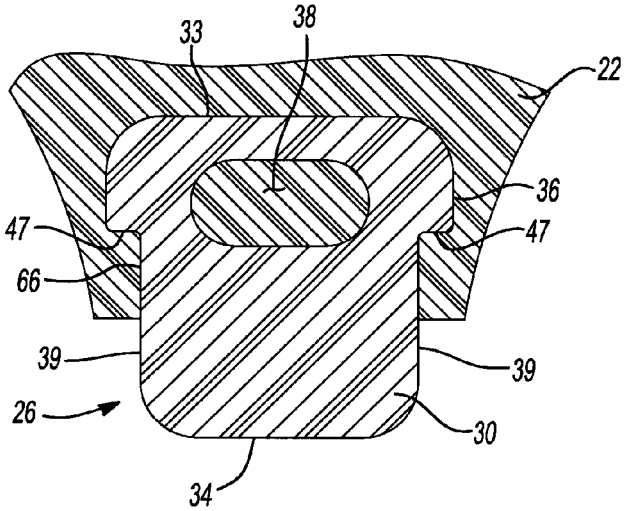
FIG. 6 is a partial cross-sectional view of the article of footwear of FIG. 1.

In the example embodiment, the stem 30 further includes a flange 36. The flange 36 can be integrally formed with the stem 30 and may extend from at least one of the first and second sidewalls 37, 39. In the example embodiment, the flange 36 extends substantially perpendicular to the first and second sidewalls 37, 39; however, it is understood that the flange 36 may extend from the first and second sidewalls 37, 39 in any direction or angle that creates a flange 36 relative to either the first or second sidewalls 37, 39. With particular reference to FIGS. 5 and 6, the flange 36 may extend from the second sidewalls 39 adjacent to the top end 33 of the stem, forming a generally flat, T-shaped stem 30. The flange 36 may also be formed at any other location between the top end 33 and the bottom end 34 of the stem 30. With reference to FIG. 6, a bottom surface 47 of the flange 36 may be substantially parallel to the bottom surface 35 of the outsole 16, and further serve to retain the cleat 16 (in an axial direction) in a relation to the outsole. It is also contemplated that the bottom surface 47 of the flange may extend from the first and second sidewalls 37, 39 such that the angle between the bottom surface 35 of the outsole 16 and the bottom surface 47 of the flange is greater than ninety (90) degrees and less than one hundred eighty (180) degrees.

Figure 7:
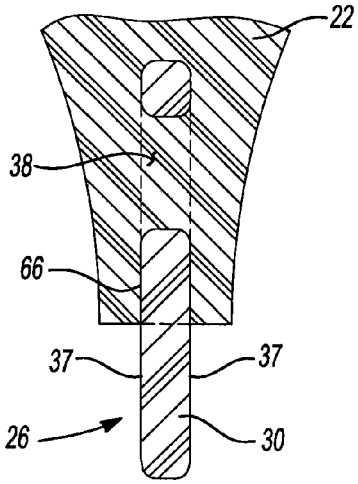
FIG. 7 is partial cross-sectional view of the article of footwear of FIG. 1.

With reference to at least FIGS. 4, 6-7, 10-11, 14-15, the process of fixing the cleat 26 to the outsole 16 will now be described in more detail. In one embodiment, the stem 30 is affixed to the outsole 16 by an insert molding process. Specifically, the stem 30 may be placed in an insert mold before the outsole 16 is molded there-around. With particular reference to FIGS. 4 and 6-7, as the first member 18 and/or second member 20 of the outsole 16, including the nodules 22, are molded, the overmold material will generally flow around each stem 30, including the flanges 36 and through the aperture 38. Accordingly, a portion of the outsole 16 may extend through the aperture 38 in a direction substantially parallel to the bottom surface 35 of the outsole. With reference to FIG. 1, it is contemplated that the entire cleat 26 may be disposed within the outsole 16 and entirely below, or external to, the midsole 14. In an article of footwear 10 that does not include the midsole 14, or includes the midsole 14 and the insole 13, the entire cleat 26 may be disposed within the outsole 16 and entirely below, or external to, the insole 13. In this way, pressure created by the force of the ground bearing on the cleat is evenly disbursed by the nodules 22, the outsole 16, the midsole 14 and/or the insole 13, before it is imparted on the user's foot.

The overmold material in and around the cleat 26, as described above, will generally fix the cleat 26 to the outsole 16. The overmold material around stem 30, including around the flange 36 and through the aperture 38, will generally prevent the cleat 26 from moving relative to the outsole 16 when a forced is applied to the cleat 26. In at least one embodiment, the molding material may flow around the stem 30 such that a portion of the stem extends perpendicularly from the bottom surface 35 of the outsole 16.

FIGS. 9-12 depict an alternative embodiment of a cleat 26'. In this embodiment, the cleat 26' includes a stem 30 and a cap 32. Except with respect to the difference discussed herein, the cleat 26' may be substantially the same as cleat 26 described above. The cap 32 may be integrally formed with the stem 30 by stamping, machining, casting, or any other technique known in the art. Alternatively, the cap 32 may be formed from a separate piece of material and attached to the stem 30 by a welding process, such as tack-welding, or any other suitable technique known in the art. In either case, the cap 32 may be formed from steel, titanium, aluminum, or any other suitable material. The cap 32 provides additional traction between the cleat 26 and the ground or surface on which the article of footwear 10 is being used. Accordingly, the cap 32 may also be referred to as a ground-engaging portion of the cleat 26'. Moreover, the cap 32 prevents dirt and debris from penetrating into the nodule adjacent to the side surfaces of the cleat 26" and thereby improves retention of the cleat 26" in the nodule over time.

With particular reference to FIGS. 9 and 12, the cap 32 may include a generally planar top surface 44, a bottom surface 46, a first arcuate end 48, a second arcuate end 50, a first sidewall 52, and a second sidewall 54. With reference to FIG. 10*b*, it is also understood that the first arcuate end 48 and the second arcuate end 50 may be substantially planar as they extend between the top surface 44 and the bottom surface 46. The top surface 44 of the cap 32 may be adjacent to, and extend beyond the periphery of, the stem 30. A cross-sectional area of the cap 32 may be larger than a cross-sectional area of the stem 30, when the cross-sectional area of the stem and the cap are taken parallel to the axis 45 of the aperture 38.

The first and second arcuate ends 48, 50 of the cap 32 may extend from the top surface 44 to the bottom surface 46. With reference to FIG. 12, and by way of example only, a height H2 of the cap 32 may be between 2 mm and 6 mm. With reference to at least FIGS. 11*a* and 11*b*, the cap 32 may have a generally triangular cross section with the first and second sidewalls 52, 54 extending between the top surface 44 and the bottom surface 46. With particular reference to FIG. 11*a*, in one embodiment, the sidewalls 52, 54 have a generally arcuate surface that may be convex relative to the axis 45 of the aperture 38. It is also understood that the sidewalls 52, 54 may be concave relative to the axis 45 of the aperture 38 as they extend between the top surface 44 and the bottom surface 46. With reference to FIG. 11*b*, the sidewalls 52, 54 may also be substantially planar as they extend between the top surface 44 and the bottom surface 46.

With reference to FIG. 9, the sidewalls 52, 54 may include a plurality of grooves 56 extending from the bottom surface 46 to a point generally between the top surface 44 and the bottom surface. The grooves 56 may have a V-shaped profile and may provide traction between the cleat 26 and the ground or surface on which the article of footwear 10 is being used.

In some embodiment, the top 44 of the cap 32 includes a channel 60 adjacent to, and extending around, the periphery of the stem 30. The channel 60 may have a variety of profiles, including V-shaped, square, or arcuate. During the molding process, a portion of the molding material for the outsole 16 and/or nodule 22 may extend into the channel 60 as best seen in FIG. 11. This feature also helps to retain the cleat 26 in the nodule 22. The channel 60 may also help to seal the stem 30 to the outsole 16, thus preventing dirt and other debris from being deposited between the cleat 26 and the outsole 16 and/or the nodule 22.

With reference to at least FIGS. 13-15, in another embodiment, a cleat 26" may include a foot 28, a stem 30, and a cap 32. Except with respect to the differences discussed herein, the cleat 26" may be substantially the same as the cleat 26'. The stem 30 may include a flange 36' to help retain the cleat 26 to the outsole 16. The flange 36' may extend from the first and/or second sidewalls 37, 39 of the stem 30 in a direction substantially parallel to the bottom surface 35 of the outsole 16. With particular reference to FIG. 13, in one embodiment, the flange 36' may form a shoulder 40 around the periphery of the stem 30.

The foot 28 may be formed from steel, titanium, aluminum, or any other suitable material. In one embodiment, the foot 28 is formed from 1050 grade stainless steel. The foot 28 may be integrally formed with the stem 30 by stamping, machining, casting, or any other technique known in the art. Alternatively, the foot 28 may be formed from a separate piece of material and attached to the stem 30 by a welding process, such as tack-welding, or any other suitable technique known in the art.

The foot 28 may be located adjacent to the top end 33 of the stem 30. With reference to at least FIGS. 16A-16C, and corresponding FIGS. 17A-17C and 18A-18C, the foot 28 may have a variety of shapes and profiles, and may extend from, and perpendicular to, the first and/or second sidewalls 37, 39 of the stem 30, forming a lip 62. With particular reference to FIGS. 14 and 15, a portion of the outsole 16 may extend around and adjacent to the foot 28 and the lip 62 to further retain the cleat 26 to the outsole 16. With particular reference to FIGS. 14-15, and the process described above for fixing the cleat 26 to the outsole 16, the overmold material for the outsole 16 and/or nodule 22 may extend around the lip 62 of the foot 28.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. It is understood that the figures may not represent the actual size of the cleats 26, and that different sizes of cleats 26 may be used on the same article of footwear 10.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. An article of footwear, comprising:

an outsole; and at least one nodule integrally formed with and extending outwardly from a bottom surface of the outsole;

at least one cleat encapsulated partially within the at least one nodule and protruding therefrom in a direction substantially perpendicular to the bottom surface of the outsole, wherein the cleat is formed from metal and the at least one nodule having arcuate side surfaces extending from the bottom surface of the outsole to a distal end from which the cleat protrudes, wherein the at least one cleat is in form of a plate defined by a top surface, a bottom surface that is ground engaging, and a first elongated planar surface substantially parallel with a second elongated planar surface, where a distance between the first and second elongated planar surfaces is less than a width of the first and second elongated planar surfaces, and a longitudinal axis of the first and second elongated planar surfaces is oriented substantially perpendicular to the bottom surface of the outsole; and an aperture is formed in the plate proximate the top surface of the plate and extending between the first and second elongated planar surfaces, such that a portion of the at least one nodule extends through the aperture in a direction substantially parallel to the bottom surface of the outsole to retain the at least one cleat in a desired position relative to the outsole.

2. The article of footwear of claim 1 wherein the aperture is further defined as an oval with a longitudinal axis of the oval oriented substantially parallel to the bottom surface of the outsole.

3. The article of footwear of claim 1 wherein the at least one cleat includes a retention portion and the retention portion of the at least one cleat having a flange extending therefrom in a direction substantially parallel to the bottom surface of the outsole.

4. The article of footwear of claim 1 further comprises a midsole having a substantially planar bottom surface, wherein the at least one cleat is disposed entirely below the bottom surface of the midsole.

5. The article of footwear of claim 1 wherein cross-sectional area between the side surfaces of the at least one nodule increases continually from the distal end to the bottom surface of the outsole.

6. The article of footwear of claim 1 wherein the outsole is formed from thermoplastic polyurethane and the thermoplastic polyurethane having a hardness in the range of 60 D to 1174 D in accordance with the ASTM D2240 standard.

7. An article of footwear, comprising:

an outsole; and at least one nodule coupled to a bottom surface of the outsole and extending outwardly therefrom;

at least one cleat encapsulated partially within the at least one nodule and protruding therefrom in a direction substantially perpendicular to the bottom surface of the outsole, wherein the cleat is formed from metal and the at least one nodule having arcuate side surfaces extending from the bottom surface of the outsole to a distal end from which the cleat protrudes, wherein the at least one cleat is formed only by a plate defined by a top surface, a bottom surface, and a first elongated planar surface substantially parallel with a second elongated planar surface, where a distance between the first and second elongated planar surfaces is less than a width of the first and second elongated planar surfaces, and a longitudinal axis of the first and second elongated planar surfaces is oriented substantially perpendicular to the bottom surface of the outsole; and an aperture formed in the plate proximate the top surface of the plate and extending between the first and second elongated planar surfaces, such that a portion of the at least one nodule extends through the aperture in a direction substantially parallel to the bottom surface of the outsole to retain the at least one cleat in a desired position relative to the outsole.

8. The article of footwear of claim 7 wherein the aperture is further defined as an oval with a longitudinal axis of the oval oriented substantially parallel to the bottom surface of the outsole.

9. The article of footwear of claim 7 wherein the at least one cleat includes a retention portion and the retention portion of the at least one cleat having a flange extending therefrom in a direction substantially parallel to the bottom surface of the outsole.

10. The article of footwear of claim 7 further comprises a midsole having a substantially planar bottom surface, wherein the at least one cleat is disposed entirely below the bottom surface of the midsole.

11. The article of footwear of claim 7 wherein cross-sectional area between the side surfaces of the at least one nodule increases continually from the distal end to the bottom surface of the outsole.

12. The article of footwear of claim 7 wherein the outsole is formed from thermoplastic polyurethane.

13. The article of footwear of claim 12 wherein the outsole formed from a thermoplastic polyurethane and the thermoplastic polyurethane having a hardness in the range of 60 D to 1174 D in accordance with the ASTM D2240 standard.

14. An article of footwear, comprising:

an outsole; and at least one nodule integrally formed with and extending outwardly from a bottom surface of the outsole, wherein the at least one nodule having one or more arcuate side surfaces extending from the bottom surface of the outsole to a distal end from which the cleat protrudes, where cross-sectional area between the side surface increases continually from the distal end to the bottom surface of the outsole;

at least one cleat encapsulated partially within the at least one nodule and protruding therefrom in a direction substantially perpendicular to the bottom surface of the outsole, wherein the cleat is formed from metal and the at least one nodule having arcuate side surfaces extending from the bottom surface of the outsole to a distal end from which the cleat protrudes, wherein the at least one cleat is formed only by a plate defined by a top surface, a bottom surface that is ground engaging and a first elongated planar surface substantially parallel with a second elongated planar surface, where a distance between the first and second elongated planar surfaces is less than a width of the first and second elongated planar surfaces, and a longitudinal axis of the first and second elongated planar surfaces is oriented substantially perpendicular to the bottom surface of the outsole;

an aperture formed in the plate proximate the top surface of the plate and extending between the first and second elongated planar surfaces, such that a portion of the at least one nodule extends through the aperture in a direction substantially parallel to the bottom surface of the outsole to retain the at least one cleat in a desired position relative to the outsole; and a midsole having a substantially planar bottom surface, wherein the at least one cleat is disposed entirely below the bottom surface of the midsole and the at least one cleat includes an aperture such that a portion of the outsole extends through the aperture in a direction substantially parallel to the bottom surface of the outsole to retain the at least one cleat in a desired position relative to the outsole.

* * * * *